United States Patent [19]

Biro

[11] 4,018,127

[45] Apr. 19, 1977

[54] ELECTRONIC MUSICAL INSTRUMENT

[76] Inventor: David W. Biro, 14 Hillside Lane, Yalesville, Conn. 06492

[22] Filed: June 2, 1975

[21] Appl. No.: 582,790

[30] Foreign Application Priority Data

Nov. 25, 1974 United Kingdom ..... 50864/74

[52] U.S. Cl. ..... 84/1.28; 84/DIG. 29

[51] Int. Cl.[2] ..... G10H 3/00

[58] Field of Search ..... 84/1.02, 1.03, 1.28, 84/461, 462, DIG. 29

[56] References Cited

UNITED STATES PATENTS

| | | | |
|---|---|---|---|
| 2,533,461 | 12/1950 | Illsley | 84/1.28 |
| 2,539,130 | 1/1951 | Grudin | 84/1.28 X |
| 2,549,145 | 4/1951 | Vagtborg | 84/1.28 |
| 2,737,840 | 3/1956 | Gratian | 84/1.28 |
| 2,784,632 | 3/1957 | Christ | 84/1.28 |
| 3,167,315 | 1/1965 | Ikeda | 84/1.28 X |
| 3,250,847 | 5/1966 | Chamberlin | 84/1.28 |
| 3,257,493 | 6/1966 | Hurvitz | 84/1.02 |
| 3,553,340 | 1/1971 | McLoughlin | 84/1.28 |
| 3,913,443 | 10/1975 | Jewett | 84/1.28 |

*Primary Examiner*—Stanley J. Witkowski

[57] ABSTRACT

An electronic musical instrument, in the nature of an organ, employs a plurality of endless magnetic tape players, each continuously playing an endless magnetic tape stored therein, each endless tape having recorded thereon a continuous tone, and a keyboard arranged such that depression of a key causes the output of a selected tape player to be played through a speaker system continuously for as long as the key is depressed.

A method of recording a continuous tone on a magnetic tape is also disclosed, in which a short loop of a master tape carrying the desired tone is fed sequentially across two transducer heads and the output of the heads is selectively fed toa tape player in the record mode so as to avoid recording the splice on the master tape.

9 Claims, 5 Drawing Figures

FIG. 1
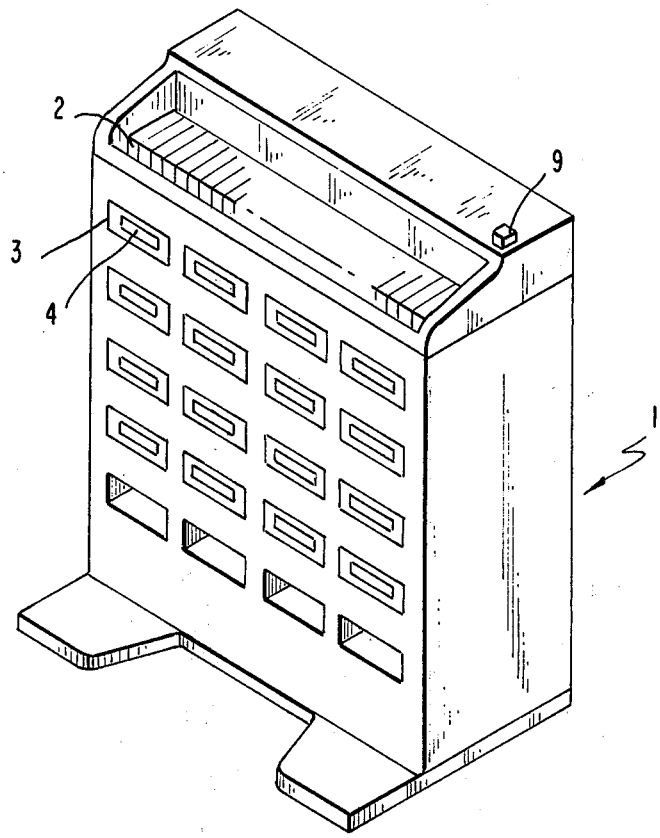
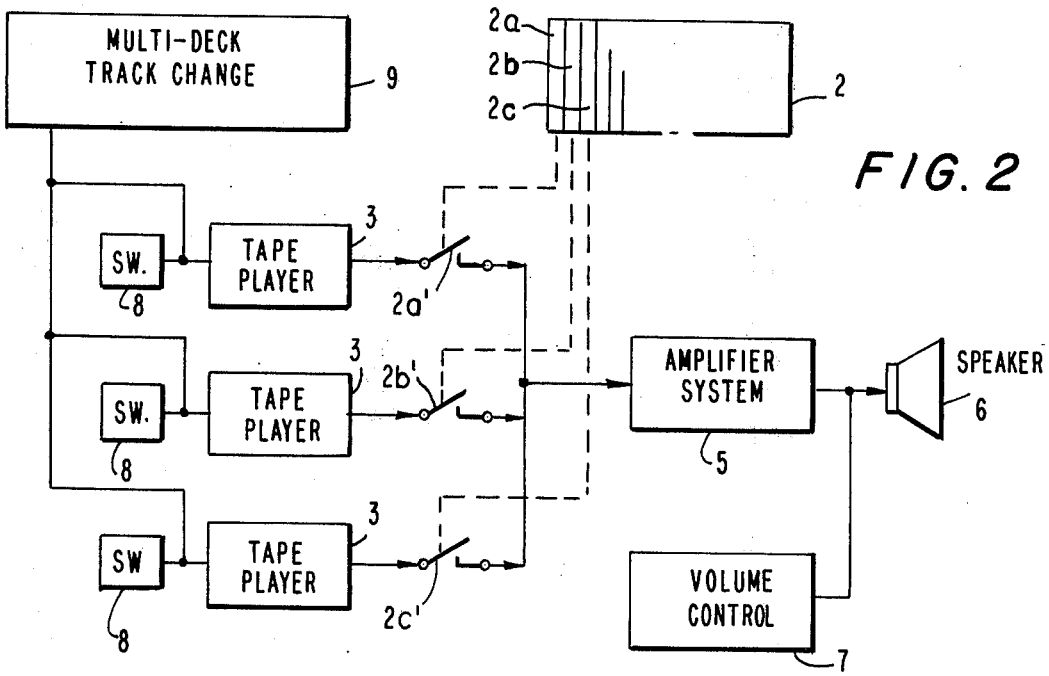
FIG. 2

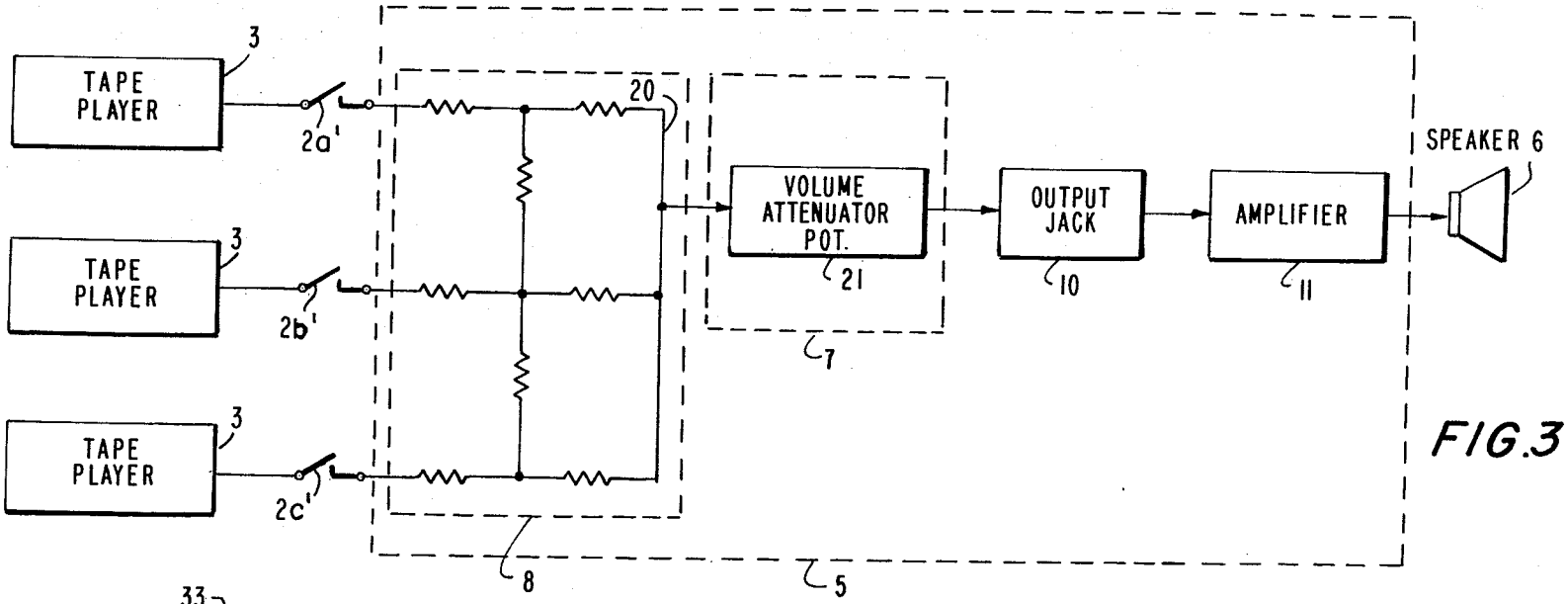
FIG. 3
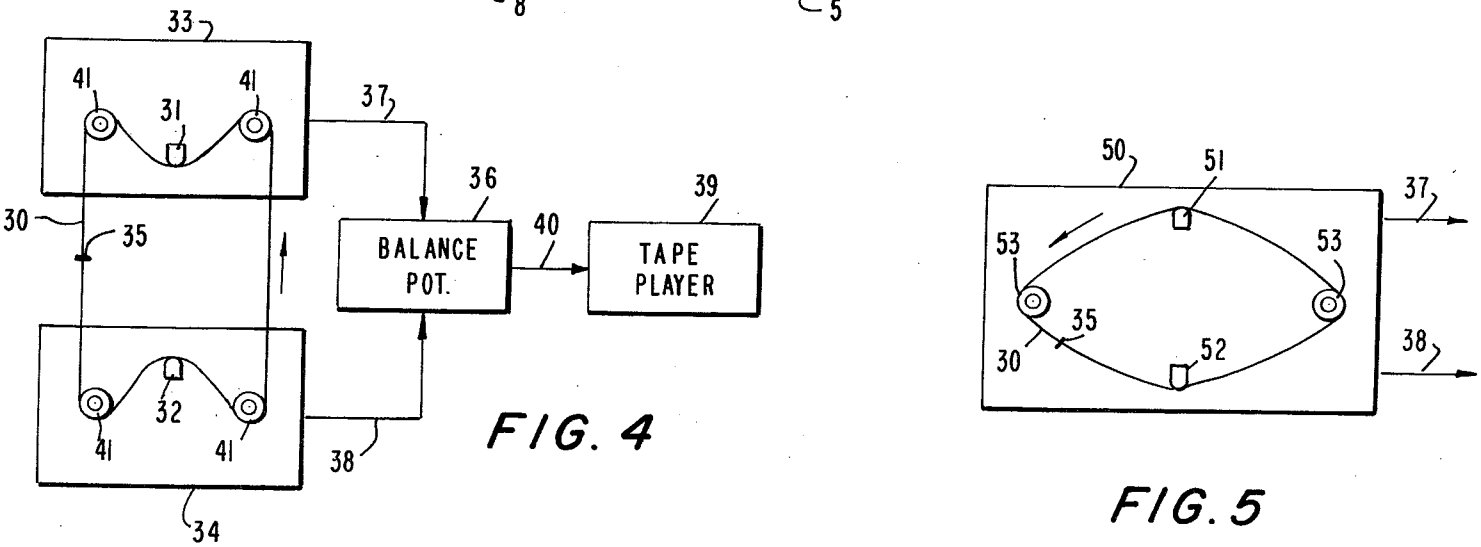
FIG. 4
FIG. 5

ELECTRONIC MUSICAL INSTRUMENT

The present invention relates to an electronic musical instrument.

Electronic musical instruments generally fall into two classes. First are the electronic organs, and the like, that produce sound synthetically, such as through oscillators, and the like. While the range of these instruments is quite remarkable, nevertheless there is still a need for an instrument capable of faithfully reproducing the actual sound of the desired instrument.

The second class is the electronic instrument that plays back the sound information recorded on a magnetic tape. These instruments store a plurality of short lengths of magnetic tape that are selectively played back when a button, or the like, is depressed. While these instruments do reproduce the actual sound of an instrument of human voice, nevertheless they have been quite complex, and once programmed with a given set of tracks, it is very difficult to add or change tapes. Also, there is a time lag between the time a button or key is depressed and the tape is transported past the playback head to be played back. Furthermore, the tapes are of relatively short length and it may occur that a given sound must be played back for a longer interval than is provided for on the tape.

These problems are solved by the present invention, which provides a new musical instrument comprising a plurality of magnetic tape cartridge players and a plurality of endless magnetic tape cartridges. Each cartridge holds a tape on which a desired sound is recorded. Each player is put into the play mode upon insertion of a cartridge therein, and once in the play mode the player continuously transports the tape in its associated cartridge past the playback head to continuously play back the sound information on the tape and thereby continuously produce an output. Between the output signal and the speaker, conveniently between the tape player and the amplification system, is a normally open switch located under a given key or button of a keyboard. When a key or button is depressed, the switch is closed, thereby allowing the output signal to be amplified, and the desired sound is emitted from the speaker. Indeed, the sound continues to be emitted from the speaker indefinitely as long as the key is depressed, since the magnetic tape carrying the recorded sound information is endless. To stop the sound, the depressed key is released and spring operation, or the like, causes the depressed key or button to be restored to its initial raised position, as in a piano or accordion, and the closed switch is thereby allowed to move back to its normally open position.

The present invention is illustrated by the accompanying drawings, in which:

FIG. 1 is a perspective view of the electronic organ of the invention;

FIG. 2 is a block diagram of the operation of the electronic organ;

FIG. 3 is a block diagram of the electronic components of the electronic organ;

FIG. 4 is a diagrammatic representation of apparatus used to record endless tapes for the electronic organ; and FIG. 5 is a diagrammatic representation of another form of recording apparatus.

FIG. 1 shows an instrument according to the invention in the form of an electronic organ 1 having a keyboard 2 and a plurality of tape players 3, of which 20 are shown. More or less players may be used, and keyboard 2 may be detached from the players 3 and only electrically connected via electrical cables.

For a given performance, players 3 are energized and are then put into the play mode by inserting an endless magnetic tape cartridge 4 into as many of the players 3 as are to be used. In the embodiment shown in FIG. 1, 16 players 3 have cartridges 4 therein, but all 20 players are energized. Each player 3 in the play mode continuously plays back the sound information recorded thereon.

In a simplified embodiment of the invention, single track tape cartridges are used, each tape having recorded thereon a different note. Thus, 16 different notes can be sounded by the embodiment shown in FIG. 1, one for each player in the play mode.

FIG. 2 is a diagrammatic illustration of how the notes are sounded. In FIG. 2 only three players 3 are shown, the others being omitted for simplicity. Thus, as shown, each tape player 3 continuously produces an output signal upon playback of the sound information on its associated tape. The signal is sent to an amplifier system 5 and a speaker 6 to produce an audible signal of desired volume. Volume control 7 is a potentiometer, or the like. Between the tape players 3 and amplifier system 5 are switches 2'*a*, 2'*b*, 2'*c*, etc., there being one switch for each player. Each switch has an actuator that is urged to the normally open position. Each switch is mechanically connected to a key 2*a*, 2*b*, 2*c*, etc. of the keyboard by locating the switch actuator under the key 2*a*, 2*b*, 2*c*, etc. As many sounds will be heard from speaker 6 as there are keys depressed. As soon as a key is released, it moves by spring action to its initial position and, likewise, the associated switch automatically returns to the open position.

When the tape player has a preamplifier section, the amplifier system 5 will include only an amplifier; otherwise there will be a preamplification stage in amplification system 5. In either case, the switches 2*a*, 2*b*, 2*c* are placed after the tape player output or at any other location prior to the amplification system.

There need be only one key 2*a*, etc. for each switch 2'*a*, etc. In a given case, all or only some of the keys will produce a sound. In the device shown in FIG. 1, the lowermost row of four decks 3 have no cartridges 4, and hence the keyboard 2 will have a number of "dead" keys.

Normally the keys in the keyboard will progress note-by-note in scales, as in a piano, but it may be desirable in some cases to arrange the notes in other patterns. Similarly, the first key on the keyboard may or may not be associated with the tape player in the left-most position of the top row (FIG. 1). All that is necessary is that the performer be aware of the note sounded by each key.

It is preferred to use multi-track tapes, and preferably 8-track tapes commonly known as STEREO-8 tapes, so as to obtain more capability from the instrument. When 8-track tapes are used with 8-track stereo players, the tracks of a given tape are paired, with tracks 1 and 2, 3 and 4, 5 and 6, and 7 and 8 being the left and right channels, respectively, of four paired tracks, which can be designated Tracks A, B, C and D. When a player is playing Track A, two separate outputs are simultaneously produced, one for the left stereo channel and one for the right. Hence, by using 8-track stereo tapes, eight notes per tape can be stored as four pairs of notes.

The 8-track tapes are used to best advantage by using both channels of all tracks. Hence, the outputs from the left and right channels of Track A are associated with two keys of the keyboard, each output being sent to the switch associated with the desired key. For example, key 2*a* and switch 2*a'* can be associated with the left channel of Track A of a tape and key 2*b* and switch 2'*b* with the right channel of Track A of that tape.

To minimize undesired sounds arising from leakage from channel to channel, the left and right channels of a given tape preferably have recorded thereon complementary notes, such as fourths, fifths, octaves, etc., although there may be cases where dissonance is not only tolerated but even desired.

The sound information carried on the tape is any sound that is normally sustained, such as the sound made by brasses, woodwinds, strings, pipe organs, the human voice, or even synthesized sound. Instruments that are plucked would not normally be suitable for recording, such as an acoustic guitar and harpsichord. A given sound produced by depressing a given key may be a single note, or two or more different notes, sounded by one or more of the same or different instruments and/or human voice, as recorded on that track corresponding to the given key. For example, a group of violins and cellos sounding a note or a chord may be more pleasant or desired than a single violin or cello sounding the same note or chord. A flute and human voice may also be a desired combination for recording a tone on a track. Even an entire orchestra could be used.

An advantage of using multi-track tapes, and preferably 8-track stereo tapes, is the ability to store on one tape the sounds of more than one instrument. For example, the top row of players 3, shown in FIG. 1, can house four cartridges, each cartridges having eight notes of four different instruments, namely on Tracks A, B, C and D, thus giving one octave per cartridge for four instruments. Eight track stereo tape players are normally provided with track changing switch 8 (FIG. 2) that change the playback head from track to track. These switches 8 are manually depressed to change over a given player to a desired track. Alternatively, a group of players can be connected to one of several multi-deck changeover switches 9, each of which is connected parallel to the switches 8. By proper choice of tapes and tracks, the operator of the electric organ 1 can sound one or more notes of one or more instruments. These notes can be played in or out of harmony, as desired. Alternatively, more than one keyboard 2 can be provided, as in a pipe organ, so that a wide range of instrumental sounds can be at the fingertips of the operator. Indeed, even sound effects, white noise, static, or any other sustained sound, can be stored on a tape and played back. One or more players could be used to store a pre-recorded program on one or more tracks, so that the operator could practice or play along with the program.

Normally, an organ 1 will be supplied with a keyboard designed for use with a given set of cartridges 4 to be inserted into players 3 in a given array. Replacement of a defective player and/or tape is independent of the remaining players and tapes. Where 8-track stereo tapes and players are used, such as described in U.S. Pat. Nos. 3,403,868 and 3,437,762 and U.S. Reissue Patent No. 27,885, the players and tapes are readily commercially available. Commercial 8-track stereo players have a changeover switch 8 built in, but they also have a switch that automatically moves the playback head to the next track on completion of a track; this latter switch must be disabled because otherwise the operator would not know precisely what track is being played back by a given tape player at a given time.

Further, the entire program of the organ 1 can be changed merely by substitution of cartridges 4. Thus, if all of the cartridges 4 carry tapes that on all tracks provide sounds of a pipe organ, one or more octaves thereof can be replaced with the sounds of woodwinds, etc. merely by changing the desired number of pipe organ cartridges for woodwind cartridges. The potential for the system is limited only by the imagination of the operator.

The amplifier system is shown in more detail in FIG. 3. As shown, the amplifier system 5 consists of a mixer 8 for mixing the outputs of the players 3. While only three players 3 are shown, the outputs of all of the players are connected to the output bus 20 so that a single, mixed signal is sent via line 10 to the volume control 7, which is a volume attenuator pot 21. The mixed signal is then sent to an output jack 10, which can be plugged into a suitable amplifier 11.

The mixer 8, as shown, employs a ladder-like separating network consisting of 470 K-ohm resistors to prevent signal feedback or cross-talk. Other mixing systems can be employed.

Conveniently, the switches 2'*a*, 2'*b*, 2'*c*, etc., the volume attenuator pot and the output jack 10 are at ground or are on a common return.

The tape players employed in the invention are conventional tape players comprising a playback head, a capstan for transporting the magnetic tape in the tape cartridge, and a drive motor for driving the capstan so as to enable the player to produce an output signal characteristic of the sound information played back by the playback head. It is a feature of this invention that each tape player has its own drive motor, capstan, and playback head so that each player is self-sufficient, when energized, to immediately go into the play mode when a cartridge is inserted into the player.

Recording of the tapes may be done in a conventional manner, and preferably is done in studio to obtain the best quality. However, the operator can record his own tapes to further personalize the organ 1 to his own needs. A particularly preferred method of recording is as follows.

The endless tapes that are used in the 8-track cartridges have a playing time of about 15 minutes per track. Ideally, a continuous tone would be recorded over the full length of each track of the tape, but this is hardly feasible. What has been done is to record a tone of a few seconds on a short endless loop of tape, and to use this loop as a master from which the tracks of the 8-track tapes are recorded.

The difficulty with this is that it is virtually impossible to prepare a master loop so that the two ends join at the same "sound". A single note played by a single instrument has harmonics and overtones, and chords or even a single note played by more than one instrument have even more complex harmonics and overtones, thereby making it highly unlikely that the end of the tone will be absolutely identical to the beginning. Accordingly, there is a splice sound every few seconds on the track of the 8-track tape.

This problem can be overcome by feeding the master loop across two transducer heads, and feeing the outputs from the heads to a balancing pot. The output from the balancing pot is then used as the input to an 8-track player in the record mode. Thus, as shown in FIG. 4, the master endless loop of tape 30 is transported in the direction shown by the arrow across the playback heads 31 and 32 of reel-to-reel tape decks 33 and 34, respectively, by having one of reels 41 connected to a motor drive (not shown). Endless loop 30 is prepared by recording a continuous tone of a few seconds, say 3 to 5 seconds, on a length of tape, and then splicing the tape together to make loop 30. A marker 35 is placed on the tape 30 at the splice so that the splice may be visually identified.

A balance pot 36 is electrically connected to the output of each tape deck by means of electrical connectors 37 and 38 and the output of the balance pot 36 is fed to the input of an endless tape player 39 via line 40. Tape player 39 is in the record mode with an endless tape (not shown) therein, so that the output of the decks 33 and 34, as controlled by the balance pot 36, is recorded directly onto a track of an endless tape (not shown) in the tape player 39 by using player 39 in the record mode.

The balance pot 36 is operated as follows. When the splice on tape 30 is in the position shown in FIG. 4, as readily observed by the position of marker 35, the balance pot mixes the outputs of decks 33 and 34 and tape player 39 records the mixed outputs. As the marker 35 moves from the position shown in FIG. 4 toward head 32, the balance pot 36 is smoothly operated to change the output signal in line 40 from a mixture of outputs from decks 33 and 34 to only that of deck 33. When marker 35 moves from head 32 to head 31, the balance pot 36 is smoothly operated to change the output signal in line 40 from the output of deck 33, to a mixture of outputs of decks 33 and 34, and finally to the output of deck 34. In this way, whenever the splice in tape 30, as readily observed via marker 35, passes through one head 31 or 32, the output signal in line 40 is the other head 32 or 31, respectively. Hence the splice in tape 30 is never heard by tape player 39.

There will be a "splice" sound on the endless tape recorded by tape player 39 when the end of tape is reached, since, as explained above, the end and beginning of a tone are normally not identical. But this splice will occur only once in the entire length of tape, i.e. once in every 15 minutes, and the probability of the organ 1 sounding the splice is quite remote.

While two tape players are used in FIG. 4, it is possible to use a single player 50 (FIG. 5) having two transducer heads 51 and 52. One of reels 53 drives tape 30, and the outputs of heads 51 and 52 are picked by leads 37 and 38 as in FIG. 4.

As explained above, while 8-track cartridges storing 8-track tapes are preferred, other endless loop tapes, having one track or more or less than 8-tracks, may be recorded with a continuous tone by the method described above. Indeed, the method of recording tapes according to the invention can be used wherever a continuous tone is to be recorded on a tape, endless or not, for a long period of time. For example, the output in line 40 from balance pot 36 need not be recorded directly on an endless loop of magnetic tape in tape player 39, but rather can be recorded on a length of tape in a reel-to-reel recorder and then this reel of tape can be used as the input to record the information on an endless loop of magnetic tape.

What is claimed is:

1. A musical instrument, comprising:

a. a plurality of magnetic tape player means for driving and transducing an endless magnetic tape having sound intelligence recorded thereon; each player means comprising a transducing means for transducing a magnetic tape and tape drive means for transporting the magnetic tape across the transducing means, the tape drive means of each player means being operated independently of the tape drive means of the other player means; a plurality of said player means each having operatively associated therewith an endless magnetic tape having sound intelligence recorded thereon; each player means being operable, when energized and in the play mode, independently of the other player means, continuously to drive and transduce its associated tape and thereby continuously produce an output signal;

b. means connected to the player means for mixing and amplifying said output signals;

c. audio means connected to said mixing and amplifying means for audibly broadcasting the output of said mixing and amplifying means applied thereto; and d. manually operated keyboard means having a plurality of keys for selecting the sound information of a desired tape, said keys being movable between a normally raised position and a depressed position, and a plurality of normally open switch means operated by said keys to remain closed for as long as a key associated with a switch means is manually held in the depressed position and to open when the key moves to the raised position, there being a key for each switch means and a switch means connected in circuit with each said player means and said mixing and amplifying means; said audio means being operable continuously to broadcast an audible tone corresponding to the sound intelligence on the tapes selected by depressing one or more of said keys for as long as said keys are depressed.

2. The musical instrument according to claim 1, wherein each endless magnetic tape has a plurality of tracks of sound information recorded thereon, and said keyboard means includes keys for selecting the sound information of a desired tract on a desired tape.

3. The musical instrument according to claim 1, wherein each endless magnetic tape has four tracks having sound information recorded thereon, each track being capable of carrying two different sound informations, each said player means being operable, independently of the other player means, continuously to produce two output signals corresponding to the two sound informations on each track being transduced, and said keyboard means includes track changing means for changing the track being transduced to another track and keys for selecting each sound information on each desired track on a desired tape.

4. The musical instrument according to claim 3, wherein said track changing means is a plurality of track changing switches, there being one such switch for each player.

5. The musical instrument according to claim 4, wherein a plurality of said track changing switches are arranged to be operated in unison so as to changeover the tracks in a plurality of players by one operation.

6. The musical instrument according to claim 3, wherein each track carries two complementary musical notes, the notes being transduced as two output signals by the associated player means.

7. The musical instrument according to claim 1, wherein each endless magnetic tape is in a cartridge, the player means being operable, when energized, immediately to go into the play mode when a cartridge is inserted into the player means.

8. The musical instrument according to claim 7, wherein each player means has a capstan, a driver motor for rotating said capstan and a playback head for transducing said tape, the capstan being operable to transport the tape across the playback head, the drive motor of each player means being operated independently of the drive motors of the other player means.

9. A musical instrument, comprising:

a. a plurality of tape cartridges, each tape cartridge containing an endless magnetic tape having sound information recorded thereon;

b. player means for transducing said tapes; said player means being operable, when energized, continuously to transduce each tape and thereby continuously produce an output signal from each tape; said player means having means for mounting the cartridges independently of one another to allow cartridges to be removed while the remaining cartridges are being transduced;

c. means connected to the player means for mixing and amplifying said output signals;

d. audio means connected to said mixing and amplifying means for audibly broadcasting the output of said mixing and amplifying means applied thereto; and e. manually operated keyboard means having a plurality of keys for selecting the sound information of a desired tape, said keys being movable between a normally raised position and a depressed position, and a plurality of normally open switch means operated by said keys to remain closed for as long as a key associated with a switch means is manually held in the depressed position and to open when the key moves to the raised position, there being a key for each switch means and a switch means connected in circuit with said player means and said mixing and amplifying means; said audio means being operable continuously to broadcast an audible tone corresponding to the sound intelligence on the tapes selected by depressing one or more of said keys for as long as said keys are depressed.

* * * * *